US005724696A

United States Patent [19]

Di Giammarino

[11] Patent Number: 5,724,696

[45] Date of Patent: Mar. 10, 1998

[54] MOP HEAD RETAINER

[76] Inventor: Silvio Di Giammarino, 59 Talman Court, Concord, Ontario, Canada, L4K 4L5

[21] Appl. No.: 760,630

[22] Filed: Dec. 4, 1996

[51] Int. Cl.[6] ..... A47L 13/258

[52] U.S. Cl. ..... 15/150; 15/147.1

[58] Field of Search ..... 15/147.1, 150, 15/178, 228, 229.2

[56] References Cited

U.S. PATENT DOCUMENTS 4,287,632 9/1981 Hammond .
4,553,282 11/1985 Batchelor ..... 15/229.2

*Primary Examiner*—Randall Chin
*Attorney, Agent, or Firm*—Bell, Boyd & Lloyd

[57] ABSTRACT

This invention reveals an improvement to a mop head retainer for use with a mop handle and mop head. The improvement involves adding a pressure bar to a protective bar. The pressure bar can be easily moved so that downward pressure can be applied to a release member. The downward pressure on the release member facilitates disengagement of a bar holding a mop head in place on the mop head retainer.

10 Claims, 3 Drawing Sheets

MOP HEAD RETAINER

FIELD OF THE INVENTION

This invention relates to a mop head retainer for use with a mop handle and mop head; and particularly to said retainer having pivoting jaw retaining means.

BACKGROUND OF THE INVENTION

Mops of the general type having a mop head retainer for a yarn-type wet mop head connected to a mop handle and having a shank, a body holding the shank and a pivotal jaw to retain and releasable grip the mop head are well-known. U.S. Pat. No. 4,287,632, published Sep. 8, 1981, relates to such a mop having a pivoting jaw retainer, a shank, an elongated body secured at its middle to the shank and a jaw operable with respect to the body to releasably grip and retain the mop head between the jaw and the body. Such a retainer is further provided with a semi-rigid release bar having one end attached to the shank at a point spaced from the body and the other end attached to the upper end of co-operating engagement means wherein downward pressure on a part of the release bar between its ends causes deflection of the release bar to release the engagement means when in position and permit the jaw to disengage and open. Removal of that downward pressure causes the release bar to return to its original position to permit reengagement of the engagement means when the jaw is to be closed.

The pivoting retaining means described in U.S. Pat. No. 4,287,632 is of commercial value in being preferably made of non-corrosive plastic components and permits ready insertion and removal of the mop head with minimal user contact. The pivoting jaw retaining means has a favourable jaw release mechanism which is intended to make unintentional disengagement difficult.

However, experience has shown that while the aforesaid release mechanism described in U.S. Pat. No. 4,287,632 makes it difficult to unintentionally operate for dis-engagement, some cleaning operators have difficulty to effect dis-engagement of the jaw release mechanism when dis-engagement is intended when manually operated. It has been found in practice that manual gripping of the mop head retainer and manually pressing the release bar to effect deflection of the release bar to cause jaw opening is difficult if operated by a less-than-strong cleaning operator, particularly if the resiliently flexible release bar is cold or insufficiently flexible. In those situations where the jaw mechanism does not permit simple release, manipulation to effect release by the user often causes unfavourable contact of the mop head with the user.

Accordingly, there is a need for a mop head retainer having pivoting jaw retaining means which overcomes the aforesaid problem.

SUMMARY OF THE INVENTION

It is an object of the present invention to provide a mop head retainer for use with a yarn-type wet head mop having pivoting jaw retaining means which retainer provides reliable, simple manual release and closing of the jaw mechanism by the user.

Accordingly, the invention provides a mop head retainer for a mop head, having a shank for connection to a mop handle, an elongated body secured at its middle to the shank, and a jaw cooperable and pivotal with respect to said body to releasably grip and retain said mop head between said jaw and said body and release it therefrom, wherein said elongated body is provided with opposite, spaced first and second terminal extensions downwardly extending from said ends of the body, one end of said jaw being pivotably secured to the lower free end of said first extension, the other free end of the jaw and the inside surface of the lower end of the second extension being provided with co-operating engagement means releasable upon spacing apart of said lower end of said second extension and the free end of said jaw in a direction generally normal to the direction of rotation of the latter at its closed position, so that when in engaged position said jaw and said body are secured in spaced parallel orientation; said second terminal extension also extending upwardly from the corresponding end of said body and being pivotably associated between its ends with said body for outward movement of said lower free end of said second terminal extension away from said jaw; the retaining means being further provided with an elongated semi-rigid release member, one end of said member is attached to said shank at a point spaced from said body, the other end of said member is attached to the upper end of said second terminal extension, whereby downward pressure on a part of said release member between its ends causes deflection of said release member to pivot said second terminal extension and consequently move the lower end of said terminal extension away from said jaw to release said engagement means when in a closed position and permit said jaw to open, and removal of said downward pressure causes said release member and said second terminal extension to return to original positions to permit re-engagement of said engagement means when said jaw is to be closed; a protective member secured to said shank and extending towards the upper end of said second terminal extension, said release member being positioned between said protective member and said body, whereby said release member is shielded against unintentional disengagement of said engagement means by unintentional deflection of said release member during use of said mop; the improvement comprising said protective member being provided with a pressure member having an abutable portion downwardly extending towards and adjacent said release member and operably abutable with said release member to effect said downward pressure on said part of said release member to effect said release of said engagement means.

In preferred embodiments, the pressure member may be integrally formed with or pivotally mounted to the protective member at a suitable part thereof.

The protective member is preferably integrally formed with the shank. When the pressure member is pivotally mounted to the protective member, it is highly desirable that the protective member be a rigid member to facilitate pivoting of the pressure member thereabout. Alternatively, when the pressure member is integrally formed with the protective member, the latter must be of a semi-rigid nature to allow for downward movement by pivotal action with respect to the shank. In a more preferred embodiment, the protective member has a neck of relatively smaller cross-sectional area formed with the shank to enhance flexibility of the protective member in this region.

BRIEF DESCRIPTION OF THE DRAWINGS

In order that the present invention may be better understood, a preferred embodiment will now be described by way of example only with reference to the accompanying drawings, wherein.

DETAILED DESCRIPTION OF A PREFERRED EMBODIMENT OF THE INVENTION

Figure 1:
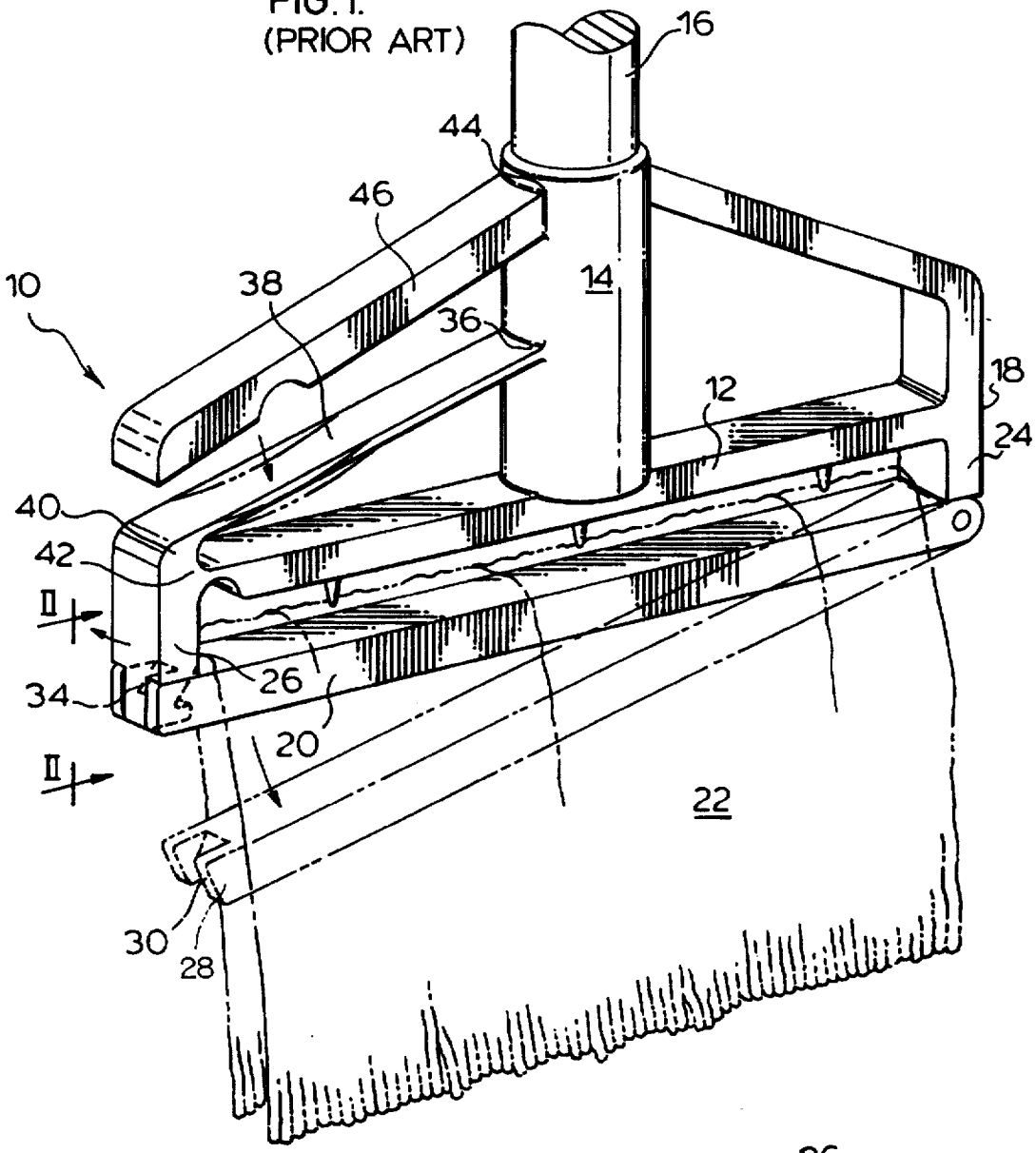
FIG. 1. (PRIOR ART)
FIG. 1 represents a perspective view of a pivoting jaw retainer as described in aforesaid U.S. Pat. No. 4,287,632 according to the prior art.

With reference to FIG. 1, this shows generally as 10 a mop head retainer having an elongated body 12 and a shank 14 which receives a mop handle 16. Body 12 at one end 18 is pivotally mounted to one end of a jaw 20, whereby jaw 20 pivots with respect to body 12 to enable a mop head 22 to be retained between body 12 and jaw 20 as hereinafter further described. Body 12 has extending opposite spaced terminal extensions 24 and 26. Jaw 20 at its free end 28 has an angled extension 30. Extension 26 at its lower end 32 has a lip 34. Angled extension 30 and lip 34 cooperate to constitute releasable engagement means such that when extension 30 and lip 34 are in engagement jaw 20 retains mop head 22 adjacent body 12.

Shank 14 at a portion 36 spaced from body 12 has an integrally formed resiliently flexible semi-rigid elongated release member 38 integrally formed with a upper portion 40 of extension 26.

Extension 26 is integrally formed with a portion 42 of body 12 wherein portion 42 is of such thickness, strength and flexibility as to allow under manual operative pressure rotary movement of extension 26 to cause outward movement of lip 34 away from extension 30 of jaw 20 to effect dis-engagement of jaw 20 from body 12.

Shank 14 at a portion 44 spaced above release member 38 has an integrally formed rigid protective member 46 outwardly extending above release member 38 and terminating adjacent portion 40. Protective member 46 shields release member 38 against unintentional deflection and unwanted dis-engagement of jaw 20 from body 12.

Figure 2:
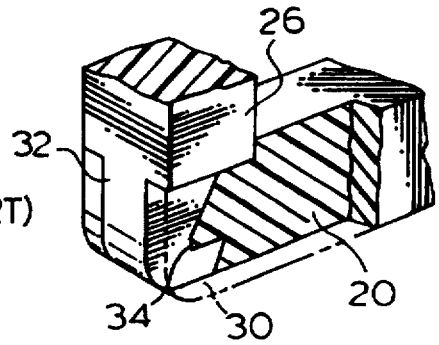
FIG. 2. (PRIOR ART)
FIG. 2 represents a enlarged perspective view of the jaw engagement means of the retaining means of FIG. 1.

Ancillary features of the embodiment shown in FIGS. 1 and 2 are described in aforesaid U.S. Pat. No. 4,287,632, which description is incorporated herein by reference.

Figure 3:
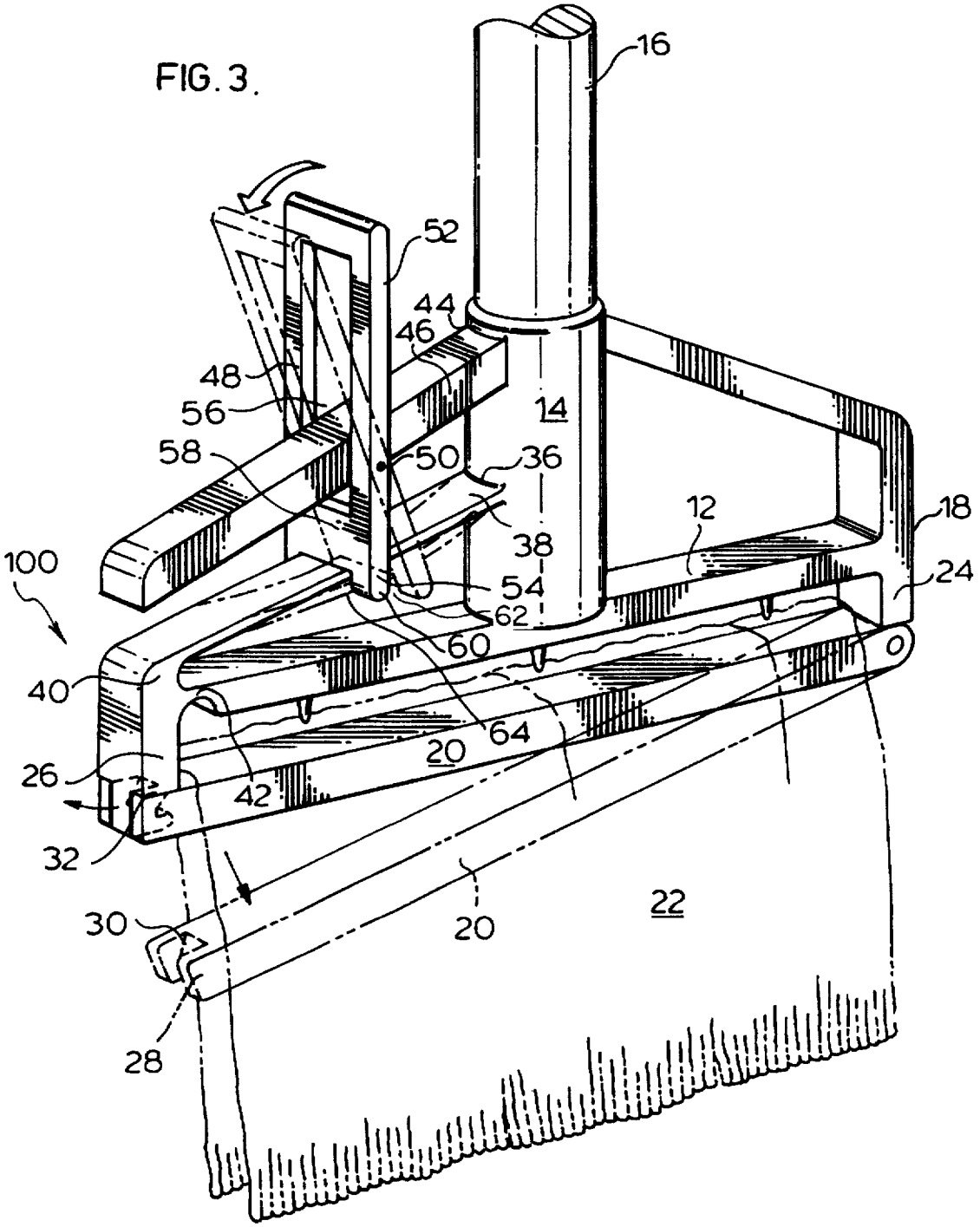
FIGS. 3, 4 and 5 represent perspective views of several alternative mop retainers according to the present invention; and wherein the same numerals denote like parts.

With reference now to FIG. 3, this shows generally as 100, the retainer of FIG. 1 modified to have an alternative release mechanism according to the invention, wherein protective member 46 is provided with a pivotally mounted elongated pressure bar 48 through pivot pin 50. Pressure member 48 has an upper portion 52 extending upwardly above protective member 46, a lower portion 54 of shorter length than portion 52, extending downwardly below protective member 46 and a substantially rectangular aperture 56 which embraces a portion of protective member 46. Lower portion 54 at its lower edge 58 has a pair of opposite spaced lugs 60 (only one shown), which, with edge 58 define a recess 62. Recess 62 receives a portion 64 of release member 38 when edge 58 intimately and forcibly abuts portion 64 when pressure member 48 is pivoted around protective member 46 to a substantially off set from a vertical position as shown in phantom.

Thus, in operation, with jaw 20 in its closed position, retaining mop head 22, lower portion 54 of pressure member 48 is in a vertical position as shown in solid lines and does not exert any pressure on portion 64 of release member 38 through abutment with edge 58. Thus, release member 38 and terminal extension 40 are in their relaxed positions. Manual handling of portion 52 to effect rotation of pressure member 48 around pivot 50 causes edge 58 to abut and exert pressure on portion 64, which distends and, thus, causes lower free end 32 of terminal extension 26 to rotate outwardly away and disengage from jaw 20. Manual return of pressure member 48 to its vertical position wherein edge 58 no longer exerts downward pressure on release member 38, causes member 38 and terminal extension 40 to return to their relaxed positions and retain jaw 20 in its engaged position.

It can be seen that release member 38 can be more easily deformed by use of pressure member 48 when the latter is rotated by hand than by pressure applied directly by the figures of a hand on release member 38 according to the aforesaid prior art retainer. Rotation of pressure member 48 around fulcrum 50 is facilitated by upper portion 52 being of greater length than lower portion 54, as will be understood from basic leverage principles.

Lugs 60 guide lower portion 54 along the upper surface of release member 38 and prevent slippage, in whole or in part, of edge 58 off the upper surface of release member 38.

Figure 4:
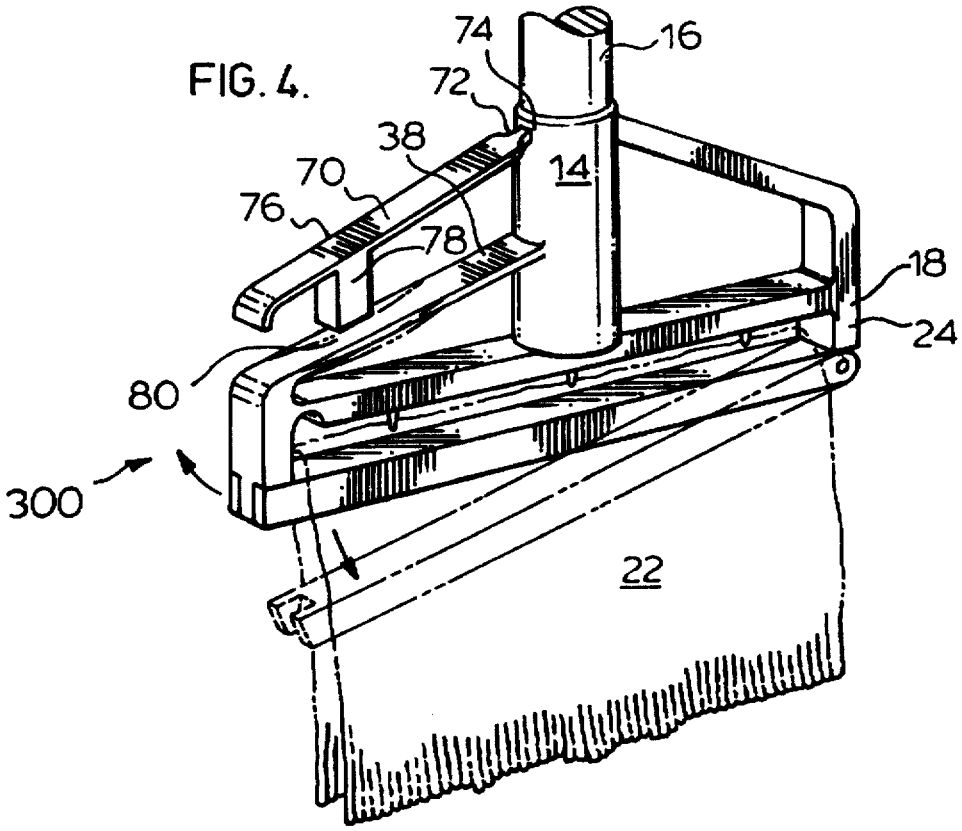

FIG. 4 shows generally as 300, a retainer having an elongated protective member 70 integrally formed at neck 72 to shank 14 at a region 74 thereof. Neck 72 is of such dimensions and flexibility as to allow pivotal downward movement of member 70 about shank 14 at region 74 when manual pressure is applied to member 70 on its upper surface at region 76, approximately two-thirds of the length of member 70 away from region 74.

Integrally formed with member 70 at its lower surface opposite region 76 is a substantially block shaped pressure member 78 extending downwardly towards and adjacent region 80 of release member 38. Pressure member 78 is of such length extending from protective member 70 that when member 70 is not under aforesaid manual pressure and, accordingly, in its relaxed position, pressure member 78 is spaced from region 80, but that when sufficient aforesaid manual pressure is applied the lower surface pressure member 78 abuts region 80 to effect distension of release member 38 to effect disengagement of jaw 20. Removal of downward pressure on member 70 causes both release members 38 and protective member 70 to return to their relaxed position and allow engagement member to be engaged.

Figure 5:
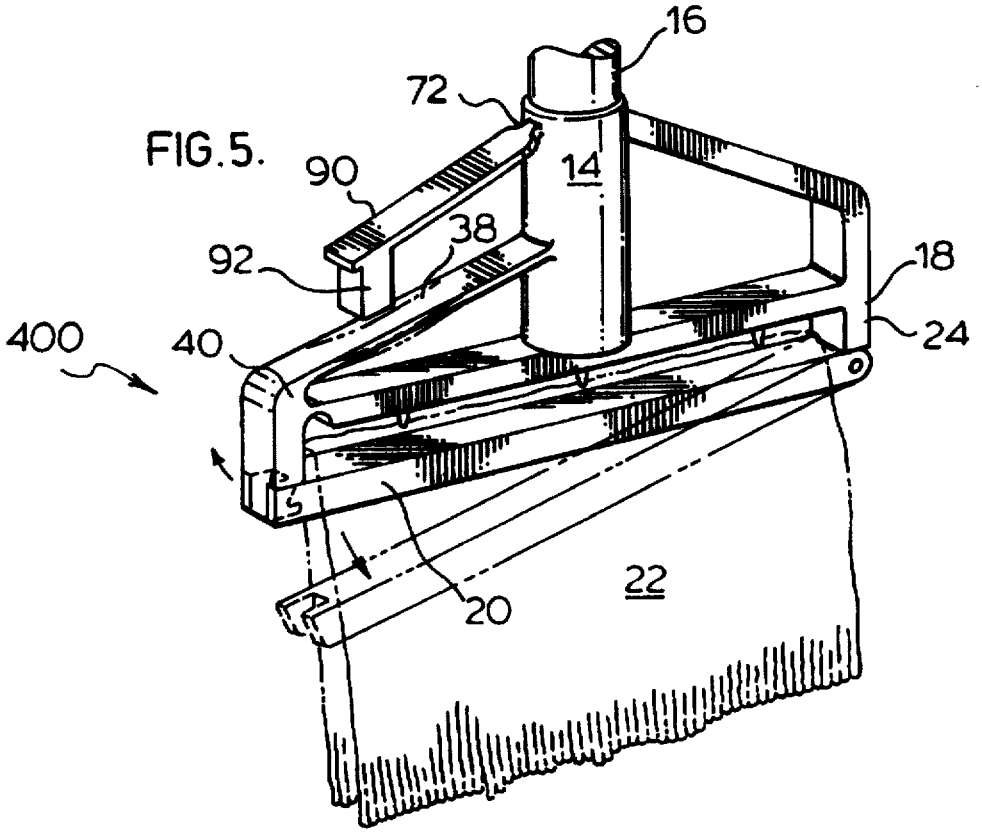

FIG. 5 shows generally as 400, a retainer similar to that of FIG. 4 but modified wherein elongated protective member 90 does not extend to terminate adjacent portion 40 of release member 38, but terminates adjacent pressure member 92.

Operation of the embodiment of FIG. 5 is similar to that for FIG. 4.

It has been found that manual manipulation of the retainers provided with a pressure member according to the invention by a less-than-strong cleaning operator desirous of removing a mop head retained thereon is easier than those retainers of the prior art.

The retainers, according to the present invention, may be made of any suitable material, preferably a polyolefin, such as polyethylene or polypropylene.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

I claim:

1. A mop head retainer for a mop head, having a shank for connection to a mop handle, an elongated body secured at its middle to the shank, and a jaw cooperable and pivotal with respect to said body to releasably grip and retain a mop head between said jaw and said body and release it therefrom, wherein said elongated body is provided with ends, retaining means, and opposite, spaced first and second terminal extensions downwardly extending from said ends of the body, said first terminal extension is provided with a lower free end, said second terminal extension is provided with a lower free end with a surface and an upper end, and said jaw has a plane of rotation and is provided with a secured end and a free end, the secured end of said jaw being pivotably secured to the lower free end of said first extension, the free end of the jaw and the surface of the lower free end of the second extension being provided with co-operating engagement means releasable upon spacing apart of said lower free end of said second extension and the free end of said jaw, so that when engaged, said jaw and said body are secured in spaced parallel orientation; the retaining means being provided with an elongated semi-rigid release member having first and second ends, said first end of said member is attached to said shank at a point spaced from said body, said second end of said member is attached to the upper end of said second terminal extension, whereby downward pressure on a part of said release member between its ends causes deflection of said release member to move said second terminal extension and consequently move the lower end of said second terminal extension away from said jaw to release said engagement means when in an engaged position and permit said jaw to open, and removal of said downward pressure causes said release member and said second terminal extension to return to their original positions to permit re-engagement of said engagement means when said jaw is to be engaged; a protective member secured to said shank and extending towards the upper end of said second terminal extension, said release member being positioned between said protective member and said body, whereby said protective member protects said release member from flexing and thereby disengaging said engagement means; the improvement comprising said protective member is provided with a pressure member having an abutable portion downwardly extending towards and adjacent said release member and operably abutable with said release member to effect said downward pressure on said part of said release member to effect said release of said engagement means.

2. A mop head retained as claimed in claim 1 wherein said pressure member is pivotally mounted to a part of said protective member and having a first portion upwardly extending above said protective member and a second portion downwardly extending below said protective member; said second portion being of such length as to enable said pressure member to adopt a first position or a second position when said member is operably rotated about said protective member such that when said pressure member is in said first position said, second portion effects the application of pressure to said release member to effect release of said engagement means and when said pressure member is in said second position, said second portion does not effect the application of pressure to said release member to effect release of said engagement means.

3. A mop head retainer as claimed in claim 2 wherein said second portion of said pressure member has a lower edge which abuts said release member when said pressure member is in said first position to effect release of said engagement means.

4. A mop head retainer as claimed in claim 3 wherein said second portion has a terminal portion having opposite spaced first and second lugs which, with said lower edge define a recess, said recess receives a part of said release member when said pressure member is in said first position.

5. A mop head retainer as claimed in claim 2 wherein said pressure member is rotatable in the same plane as the plane of rotation of said jaw.

6. A mop head retainer as claimed in claim 2 wherein said first portion of said pressure member is of greater length than said second portion of said pressure member.

7. A mop head retainer as claimed in claim 2 wherein said pressure member has a portion defining a substantially rectangular aperture through which said part of said protective member extends.

8. A mop head retainer as claimed in claim 2 wherein said protective member is rigid.

9. A mop head retainer as claimed in claim 1 wherein said protective member is semi-rigid and has one end pivotally associated with said shank as to allow for downward movement of the other end of said protective member, whereby downward pressure on said protective member causes said downward movement of said abutable portion with said release member to effect said release of said engagement means.

10. A mop head retainer as claimed in claim 9 wherein said protective member is integrally formed with said shank and integrally formed with said abutable portion.

* * * * *